US005896769A

United States Patent [19]

Elpern et al.

[11] Patent Number: 5,896,769

[45] Date of Patent: Apr. 27, 1999

[54] ELECTRICALLY OPERATED ACTUATOR

[75] Inventors: Stephen R. Elpern, Chicago, Ill.; David G. Elpern, Los Angeles, Calif.; Allen C. Ward; Walid Habib, both of Ann Arbor, Mich.; Paul Evans, Chicago; Scott Padiak, Winnetka, both of Ill.

[73] Assignee: Access Technologies, Inc., Chicago, Ill.

[21] Appl. No.: 08/713,895

[22] Filed: Sep. 13, 1996

[51] Int. Cl.[6] ..... E05B 47/00

[52] U.S. Cl. ..... 70/279

[58] Field of Search ..... 70/275, 277–283; 292/201, 144, 336.3; 340/825.31; 361/172

[56] References Cited

U.S. PATENT DOCUMENTS

| | | | |
|---|---|---|---|
| 2,665,577 | 1/1954 | Sanowskis | 70/133 |
| 2,750,786 | 6/1956 | Sanowskis | 70/313 |
| 3,733,861 | 5/1973 | Lester | 70/153 |
| 4,135,377 | 1/1979 | Kleefeldt et al. | 70/279 X |
| 4,148,092 | 4/1979 | Martin | 361/172 |
| 4,317,147 | 2/1982 | Daughenbaugh et al. | 360/113 |
| 4,317,157 | 2/1982 | Eckloff | 361/172 |
| 4,596,985 | 6/1986 | Bongard et al. | 340/825.31 |
| 4,631,527 | 12/1986 | De Witt et al. | 340/539 |
| 4,665,727 | 5/1987 | Uyeda | 70/279 |
| 4,677,834 | 7/1987 | Hicks | 70/279 |
| 4,691,542 | 9/1987 | Young | 70/279 X |
| 4,743,898 | 5/1988 | Imedio | 340/825.31 |
| 4,786,900 | 11/1988 | Karasawa et al. | 340/825.31 |
| 4,802,353 | 2/1989 | Corder et al. | 70/277 |
| 4,808,995 | 2/1989 | Clark et al. | 340/825.31 X |
| 4,849,749 | 7/1989 | Fukamachi et al. | 340/825.31 |
| 4,854,143 | 8/1989 | Corder et al. | 70/218 |
| 4,864,494 | 9/1989 | Kobus, Jr. | 364/200 |
| 4,893,704 | 1/1990 | Fry et al. | 292/201 X |
| 4,931,789 | 6/1990 | Pinnow | 340/825.31 |
| 5,103,221 | 4/1992 | Memmola | 340/825.31 |
| 5,107,258 | 4/1992 | Soum | 340/825.31 |
| 5,148,691 | 9/1992 | Wauden | 70/279 |
| 5,199,288 | 4/1993 | Merilainen et al. | 70/279 |
| 5,204,672 | 4/1993 | Brooks | 340/825.31 X |
| 5,280,881 | 1/1994 | Karmin | 70/279 |
| 5,328,218 | 7/1994 | Brusasco et al. | 292/201 |
| 5,379,033 | 1/1995 | Fujii et al. | 340/825.31 X |
| 5,406,274 | 4/1995 | Lambropoulos et al. | 340/825.31 X |
| 5,441,315 | 8/1995 | Kleefeldt et al. | 292/201 |
| 5,442,341 | 8/1995 | Lambropoulos | 340/825.31 |
| 5,475,377 | 12/1995 | Lee | 340/825.34 |
| 5,486,812 | 1/1996 | Todd | 340/539 |
| 5,487,289 | 1/1996 | Otto, III et al. | 70/279 |
| 5,504,478 | 4/1996 | Knapp | 340/825.69 |
| 5,508,687 | 4/1996 | Gebhardt et al. | 340/825.31 |
| 5,526,710 | 6/1996 | Ohta | 292/201 X |
| 5,628,535 | 5/1997 | Buscher et al. | 292/201 |
| 5,634,676 | 6/1997 | Feder | 70/279 X |

OTHER PUBLICATIONS

Weiser Lock Powerbolt Electronic Keyless Entry System Packaging, © 1996.

Weiser Lock Powerbolt, *Installation & Programming Instructions Owner's Manual*, No Date.

Photographs of the Weiser Lock Powerbolt.

*Primary Examiner*—Suzanne Dino Barrett

*Attorney, Agent, or Firm*—Reginald J. Hill

[57] ABSTRACT

An electrically operated actuator (12, 112, 212, 312) automatically operates dead-bolt assemblies and other locks, while preserving manual operation of the locks. The actuator assembly has rotating means for rotation of the drive bar (18), which in turn extends or retracts the bolt (14) of the lock. The rotating means may be a lever (28, 128, 238, 328, 438) attached to the drive bar (18) that is pivotable about the axis of rotation of the drive bar (18). The actuator assembly has driving means that forces the rotating means to rotate. The driving means is responsive to an electrical signal, which, for example, may be initiated from a remote-controlled transmitter (502, 602). The driving means may include a motor (20, 120, 220) for rotating a rod (22, 122, 222, 322) that in turn operates an assembly that rotates or drives the rotating means. In response to an electrical signal, the driving means actuates the rotating means to affect either a locking or unlocking operation, which operations are always completed by placing the actuator assembly in a state whereby the bolt of the lock may subsequently be extended or retracted manually, or automatically by the driving means.

12 Claims, 14 Drawing Sheets

ELECTRICALLY OPERATED ACTUATOR

The present invention generally relates to an actuator assembly, and more specifically, to an electrically operated actuator for use with dead-bolt assemblies and other door locks.

BACKGROUND OF THE INVENTION

A convenient and reliable locking assembly for doors is a critical and important part of any security system. In commercial settings, property must be secured to prevent theft and vandalism. In residential settings, a convenient and reliable locking assembly may even be more important where the safety of the inhabitants is also at stake.

Traditionally, mechanically operated locking assemblies are used in which the operator inserts a key into the locking device and then rotates the key to retract or extend a bolting mechanism. While this mechanical solution is reliable, there are many inconveniences associated with using a mechanical key system. For example, for a person in a dark area, it is difficult to find the key, orient the key, and insert it into the lock. Also, for a person occupied with carrying items, it is difficult to manage the items and also manipulate a key. These are only a few of the many limitations and inconveniences associated with a mechanically operated locking system.

Electrically operated locking assemblies have been proposed to address the limitations of purely mechanical locks. For example, U.S. Pat. Nos. 3,733,861, 4,148,092 and 5,487,289, issued to Lester, Martin and Otto, Ill., et al., respectively, disclose electrically activated locks. However, these locks provide an electrically operated passive means for restraining manual operation of the bolt mechanism. These systems do not have an active means for extending and retracting the bolt mechanism directly. Further, some of these systems do not allow concurrent manual and electric operation.

Recently the automobile industry has adopted remote controlled devices to actuate automobile door locks. The convenience of these remote control capabilities is tremendous in comparison with mechanically operated locks and has been well accepted by consumers. However, the use of remote controlled locking systems for doors outside of the automobile industry has been limited due to no reliable and economical actuating assembly which can be used with doors and dead-bolt assemblies such as those found in residences. In particular, there is no actuating assembly which can be adapted to utilize conventional dead-bolt assemblies and also retain the ability to use the conventional key method of operating a dead-bolt assembly. Further, there is no actuating assembly that can be retrofit to an existing dead-bolt assembly.

Therefore, a need exists for an electrically operated actuator assembly for automation of the locking and unlocking of dead-bolt assemblies, and in particular, a need exists for an electrically operated actuator assembly that can preserve the conventional key method of operation and also be retrofit to an existing dead-bolt assembly.

SUMMARY OF THE INVENTION

Accordingly, an object of the present invention is to provide a convenient and reliable electrically operated actuating assembly.

A further object of the present invention is to provide an electrically operated actuator assembly which can be adapted to respond to a remote transmitter/receiver device.

Another object of the present invention is to provide an electrically operated actuator assembly which can readily be adapted to dead-bolt assemblies for doors so that both a conventional key and a remote transmitter can be utilized to operate the dead-bolt assembly.

Another object of the present invention is to provide an electrically operated actuator assembly which can be easily added to, or retrofit for, a conventional dead-bolt assembly already installed on a door.

In accordance with the present invention, all of these objects, as well as others not herein specifically identified, are achieved generally by an electrically operated, remote-controlled actuator assembly which can be used with a locking system while preserving the option of using a key in a standard mode. More specifically, as discussed below, the present invention includes a driving means and a rotating means which operate on a conventional lock or dead-bolt assembly.

A conventional dead-bolt assembly includes a bolt, a drive bar, a cylinder which receives a conventional key on the exterior side of the door, and either a knob or another cylinder on the interior side of the door. The bolt is coupled to the drive bar such that rotation of the drive bar extends or retracts the bolt, depending on the direction of rotation. The exterior cylinder and the interior cylinder, if there is one, are coupled to the drive bar such that a key may be inserted into either cylinder and turned to rotate the drive bar, extending or retracting the bolt. Similarly, if there is a knob, rather than a cylinder, attached to the drive bar, the bolt can be extended or retracted by rotation of the knob.

In accordance with the present invention, a rotating means is coupled to the drive bar such that the rotating means is capable of rotating the drive bar and thus the bolt. The driving means, in response to an electrical signal, actuates the rotating means to effect the extension or retraction of the bolt, causing a locking or unlocking operation. After actuation by the driving means, the rotating means is placed in a state whereby the bolt may be extended or retracted manually, that is, by use of a key or knob, or automatically by the driving means.

In one embodiment, the rotating means includes a resilient lever that is attached to the drive bar to rotate the drive bar, causing the bolt to extend and retract. The resilient lever has an axis of rotation that is coaxial with the axis of rotation of the drive bar. The driving means includes a motor capable of bidirectional rotation of a threaded rod extending therefrom. A threaded member is screwed onto the threaded rod, but means are provided to prevent rotation of the threaded member about the threaded rod, thereby allowing the threaded member to extend along the length of the threaded rod, depending on the direction of rotation of the motor. The threaded member has a protrusion positioned to engage the lever and pivot the lever from a first position wherein the bolt is extended, to a second position wherein the bolt is retracted. The lever is resilient so that the protrusion on the threaded member may force the lever out of its path when the lever has reached the end of its range of rotation, for example, when the lever has attained the first position or the second position. This allows the protrusion to be placed in a position such that the lever is free for rotating manually, as is required for key or knob operation, and also places the protrusion in position for reciprocal movement of the lever.

In another embodiment, the rotating means includes a rigid, non-resilient lever that is attached to the drive bar to rotate the drive bar, causing the bolt to extend and retract. The rigid lever has an axis of rotation that is coaxial with the axis of rotation of the drive bar and is pivotable from a first position wherein the bolt is extended, to a second position wherein the bolt is retracted. The driving means includes a bidirectional motor capable of rotating a threaded rod extending therefrom. An actuating arm with a first protrusion at one end of the arm and a second protrusion at the opposite end of the arm is threaded onto the threaded rod such that rotation of the motor causes the arm to extend along the length of the threaded rod. The actuating arm is placed with respect to the lever such that the levers range of motion, that is, from the first position to the second position, is always between the first and second protrusions of the actuating arms. Thus, one protrusion can be extended by the motor to pivot the lever from the first position to the second position, while the second protrusion can be extended by the motor to pivot the lever from the second position to the first position. Whenever the motor is cycled to force the lever to a particular position, after the desired position is obtained, the motor automatically cycles in the opposite direction to place the protrusions in position for manual operation of the lock and for subsequent electrical operation.

Several other alternatives for driving means, including solenoids are disclosed. Additionally, alternative rotating means including circular gears and various lever arrangements are disclosed. Preferably, the rotating means includes an adaptor that is easily positioned over a drive bar of an existing lock, the adaptor including either the resilient or non-resilient lever and an extended drive bar for receiving a knob or interior cylinder.

Electrical activation is accomplished in the invention by use of a remote control unit. The remote control unit includes at least a transmitter, a receiver and a control circuit. Preferably, the transmitter is also a receiver or a transmitter/receiver and the receiver is also a transmitter or a receiver/transmitter. The transmitter/receiver sends a signal to lock or unlock. The signal is received by the receiver/transmitter and sent to the control circuit. The control circuit activates the driving means in accordance with the signal received by the receiver/transmitter and monitors the status of the lock. The status monitored by the control circuit, as determined by appropriate sensors, includes successful or unsuccessful completion of rotation of the rotating means to the locked or unlocked position. The status determined by the control circuit is sent by the receiver/transmitter to the transmitter/receiver, which may give a visual and/or audible indication to the user.

The invention includes a method for retrofitting an existing lock or dead-bolt assembly with an electrically operated actuator. The existing lock has an interior cylinder or knob, an exterior cylinder, a drive bar and existing mounting hardware, such as bolts. In accordance with the method, first the interior cylinder or knob is removed. Then, a support plate having an opening formed therein and a preassembled actuator in accordance with the present invention mounted thereon is mounted on the door such that the opening formed in the plate receives the existing mounting hardware from the exterior cylinder. A mounting plate is then aligned over the support plate such that bores in the mounting plate receive the existing mounting hardware from the exterior cylinder. A lever having an axis of rotation that is coaxial with an axis of rotation of the drive bar is coupled to the drive bar prior to securely reattaching the interior cylinder or knob and any desired protective cover.

BRIEF DESCRIPTION OF THE DRAWINGS

Further objects of the invention, taken together with additional features thereto and advantages occurring therefrom, will be apparent from the following description of the invention when read in conjunction with the accompanying drawings, wherein.

DETAILED DESCRIPTION OF THE PREFERRED EMBODIMENTS

Figure 1:
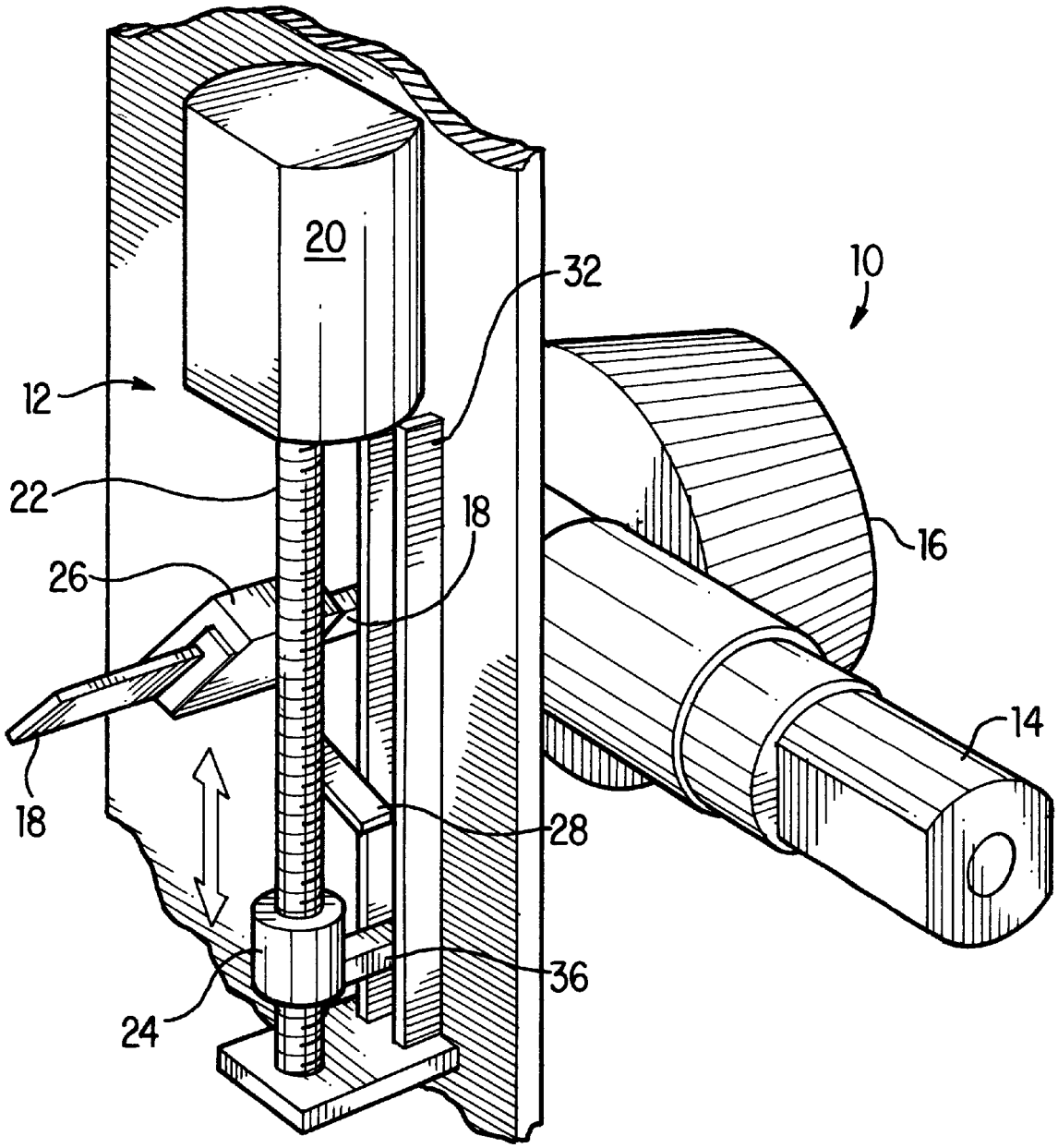
FIG. 1 is a perspective view of a dead-bolt assembly coupled with an electrically operated actuator embodiment in accordance with the present invention, wherein the dead-bolt assembly is in the locked position.

FIG. 1 shows a dead-bolt assembly, generally designated as 10, which can be driven by an electrically operated actuator, generally designated as 12, in accordance with the present invention. The dead-bolt assembly 10 consists of a bolt 14, an exterior drive cylinder 16 and a drive bar 18. An interior drive cylinder (not shown), or knob (not shown), may be attached to the end of drive bar 18 opposite exterior drive cylinder 16. Drive bar 18 is coupled to bolt 14 in a conventional manner such that rotation of drive bar 18 extends or retracts bolt 14. Cylinder 16 is coupled to drive bar 18 in a conventional manner such that rotation of a proper key in cylinder 16 rotates drive bar 18. Thus, drive cylinder 16 extends or retracts bolt 14 depending on the rotational direction of the key.

Drive cylinder 16 and bolt 14 are separated from electrically operated actuator 12 by a plate 34 having an opening (not shown) for the drive bar 18 to extend through. Plate 34 may be mounted to the door (not shown). Plate 34 is not necessary, but provides a convenient base to which electrically operated actuator 12 may be mounted. Any similar substitute structure would suffice.

The embodiment of the electrically operated actuator assembly 12 depicted in FIG. 1, consists of driving means, including a motor 20 and a threaded rod 22, and rotating means, including a nut 24, an adaptor 26, a lever 28 and a guide 32. It is preferable to secure motor 20 to plate 34. Threaded rod 22 is connected at one end to electric motor 20, which is capable of bi-directional rotation and also has overload protection. Nut 24 has a hole that is threaded for receiving threaded rod 22, and a tongue 36 that extends radially outward from nut 24. Adaptor 26 is secured on drive bar 18 and is utilized to secure resilient lever 28 to extend radially away from drive bar 18. Resilient lever 28 is either spring-loaded, as is known in the art, or is sufficiently resilient so that it can be pushed to one side or the other and will always return to its original position. Guide 32, preferably secured onto mounting plate 34, defines a channel adapted to receive tongue 36 and to allow sliding movement of tongue 36 along the length of the channel. Guide 32 is aligned in parallel orientation with threaded rod 22 so that tongue 36 will remain in the channel throughout movement of the nut 24 along the length of threaded rod 22.

When motor 20 is activated, threaded rod 22 is rotated. Depending on the direction of rotation and threading, nut 24 will be raised or lowered along the length of rod 22 from a first or locked position to a second or unlocked position. Tongue 36 is retained in guide 32 to prevent nut 24 from rotating.

Figure 1A:
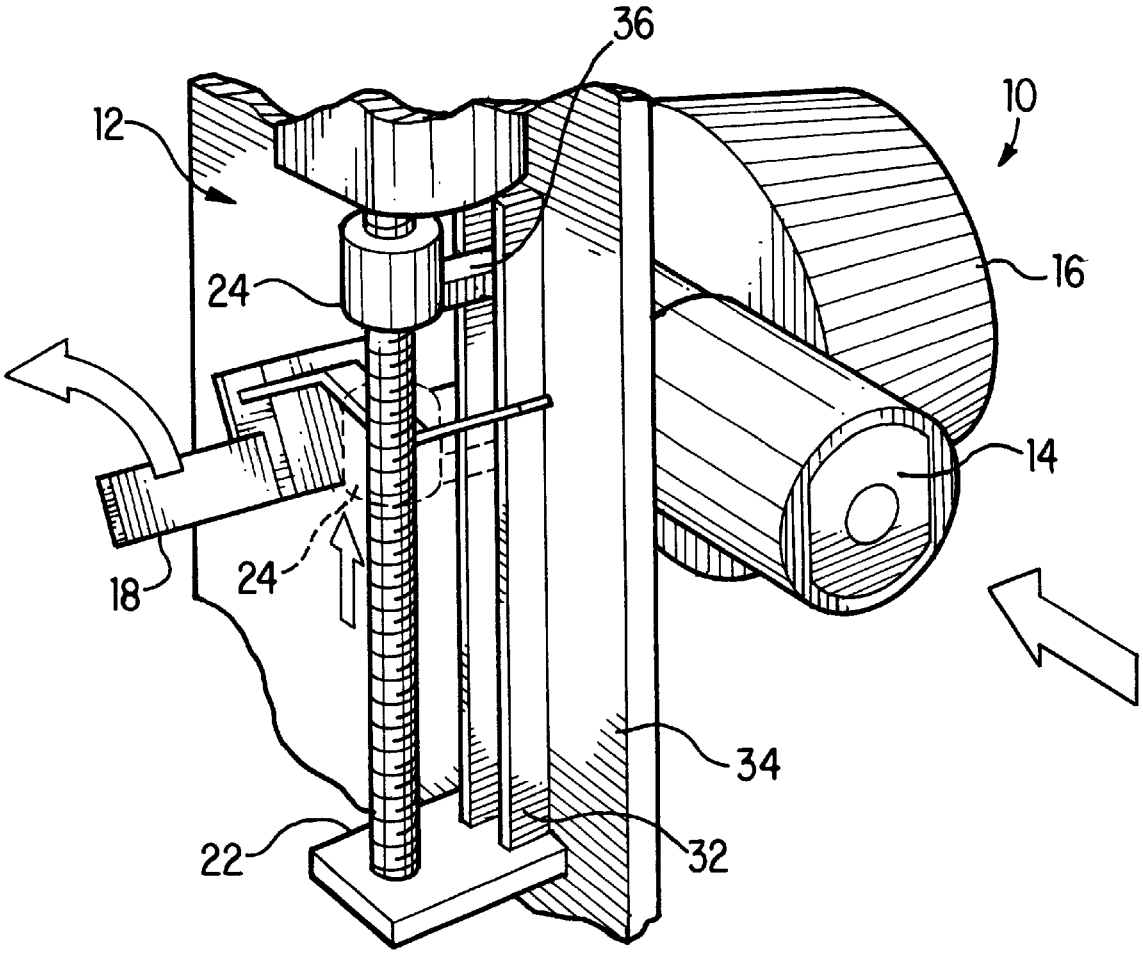
FIG. 1A perspective view of the dead-bolt assembly and actuator shown in FIG. 1, wherein the dead-bolt assembly is in the unlocked position.

From the locked position shown in FIG. 1, motor 20 can be activated to unlock dead-bolt assembly 12 by raising nut 24. As nut 24 is raised, tongue 36 will exert an upward force on lever 28, moving lever 28 towards the upper or unlocked position, causing drive bar 18 to rotate counterclockwise. The rotation of drive bar 18 will cause bolt 14 to retract, thus unlocking the door. Drive bar 18 does not rotate further counterclockwise once bolt 14 is fully retracted. (See nut 24 in phantom in FIG. 1A). However, motor 20 continues to drive nut 24 upward, pushing it through the flexing resilient lever 28, until tongue 36 is driven beyond lever 28. Lever 28 then rebounds to its original position. As shown in FIG. 1A, tongue 36 is then ready to drive lever 28 in an opposite direction, i.e., back to the locked position. Additionally, tongue 36 is positioned not to interfere with lever 28 if a user rotates drive bar 18 by using a key or knob.

From the unlocked position shown in FIG. 1A, motor 20 can be activated to lock dead-bolt assembly 12 by lowering nut 24 until it pushes lever 28 downward, thus causing the drive bar 18 to rotate in a clockwise direction. The rotation of drive bar 18 extends bolt 14. Once bolt 14 is fully extended, drive bar 18 does not rotate further in the clockwise direction. However, nut 24 continues in its downward path until tongue 36 pushes through resilient lever 28. After tongue 36 is driven beyond lever 28, as shown in FIG. 1, motor 20 stops operation. Resilient lever 28 then rebounds to its original position such that tongue 36 is in a position to catch lever 28 when tongue 36 is driven in the opposite direction. Notably, when motor 20 stops operation, tongue 36 is positioned not to interfere with manual operation of dead-bolt assembly 10, that is, operation with a key or knob.

Figure 2:
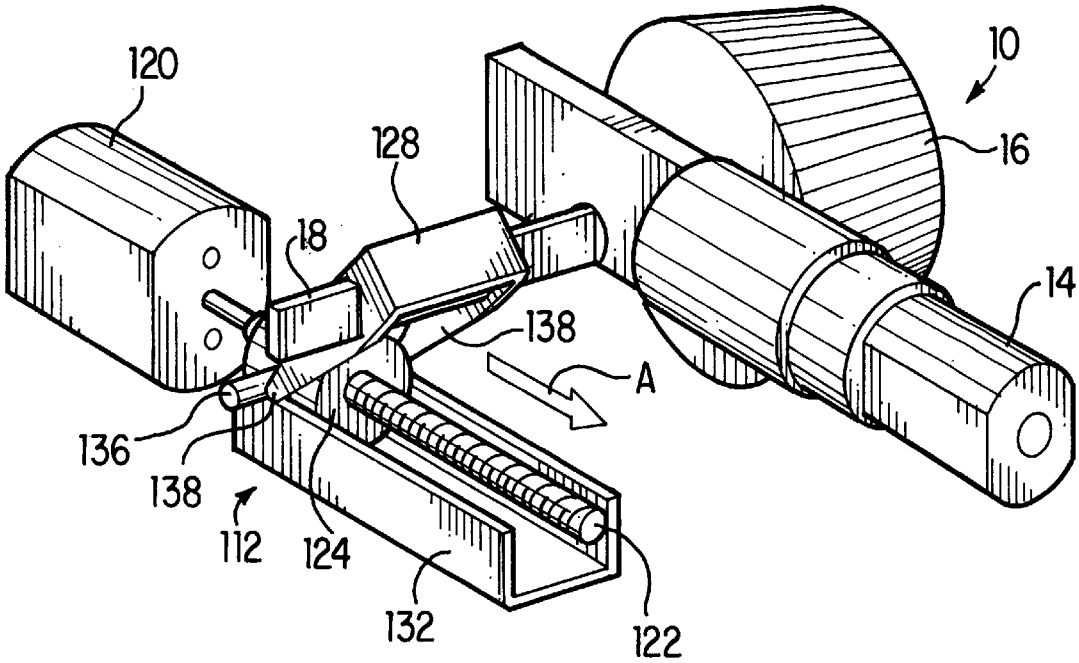
FIG. 2 is a perspective view of a dead-bolt assembly coupled with another electrically operated actuator embodiment in accordance with the present invention, wherein the dead-bolt assembly is in the locked position.

Turning now to FIG. 2, dead-bolt assembly 10 is shown driven by an electrically operated actuator 112 in accordance with another embodiment of the present invention. A motor 120 is horizontally oriented such that a threaded rod 122 attached to motor 120 and a guide 132 are parallel to bolt 14. In this embodiment, guide 132 receives a portion of a generally cylindrical nut 124, which is capable of sliding movement along the length of the channel defined by guide 132. Nut 124 is provided with two prongs 136 (see FIG. 2A) which extend radially out from nut 124 and rest along guide 132. Prongs 136 prevent rotation of nut 124 when threaded rod 122 is rotated by motor 120. A U-shaped lever 128 having a pair of resilient arms 138 is secured directly onto drive bar 18.

Figure 2A:
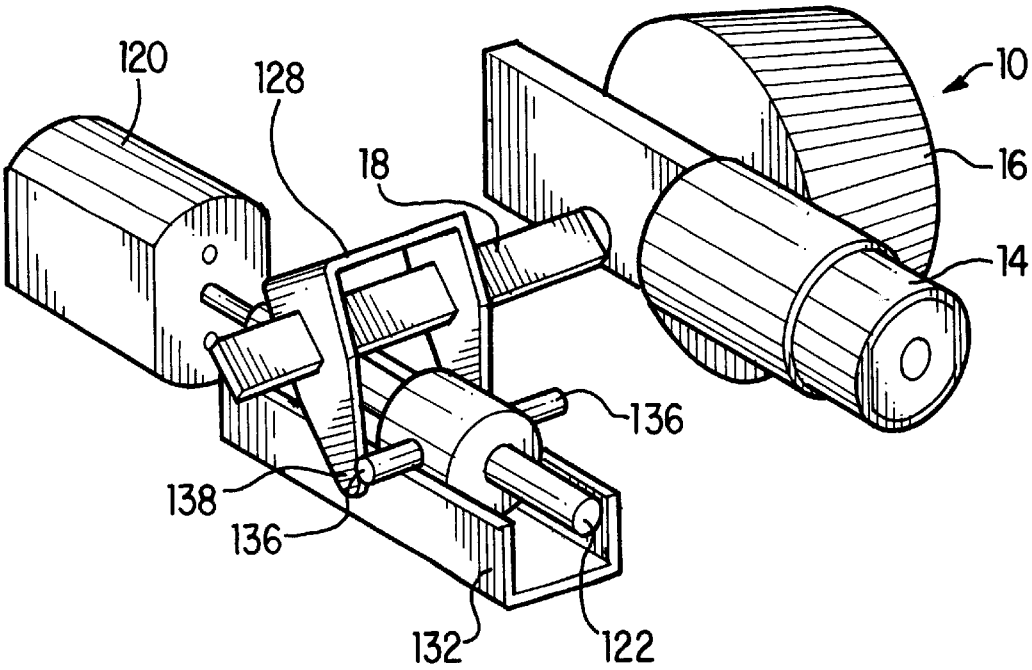
FIG. 2A is a perspective view of the dead-bolt assembly and actuator shown in FIG. 2, wherein the dead-bolt assembly is in the unlocked position.

Motor 120 is activated to rotate threaded rod 122, which in turn causes linear movement of nut 124 along guide 132 to affect a locking or unlocking operation. For example, dead-bolt assembly 110 is shown in a locked position in FIG. 2. If an unlocking operation under control of electrically operated actuator 112 is desired, motor 120 is activated to cause nut 124 to move in the direction of arrow A. Prongs 136 of nut 124 contact resilient arms 138 of lever 128. The progression of nut 124 along guide 132 causes prongs 136 to force resilient arms 138 to rotate lever 128, causing a corresponding rotation of drive bar 18, which results in the retraction of bolt 14. Drive bar 18 reaches the end of its rotational travel when bolt 14 is completely retracted. This prevents further rotation of lever 128. However, motor 120 continues to extend nut 124 along guide 132, forcing prongs 136 to bend resilient arms 138, eventually forcing prongs 136 and nut 124 to extend beyond resilient arms 138, as shown in FIG. 2A. When motor 120 stops, prongs 136 are positioned beyond resilient arms 138 to facilitate manual operation of the lock and also to facilitate a locking operation by reversing the direction of motor 120.

Figure 3:
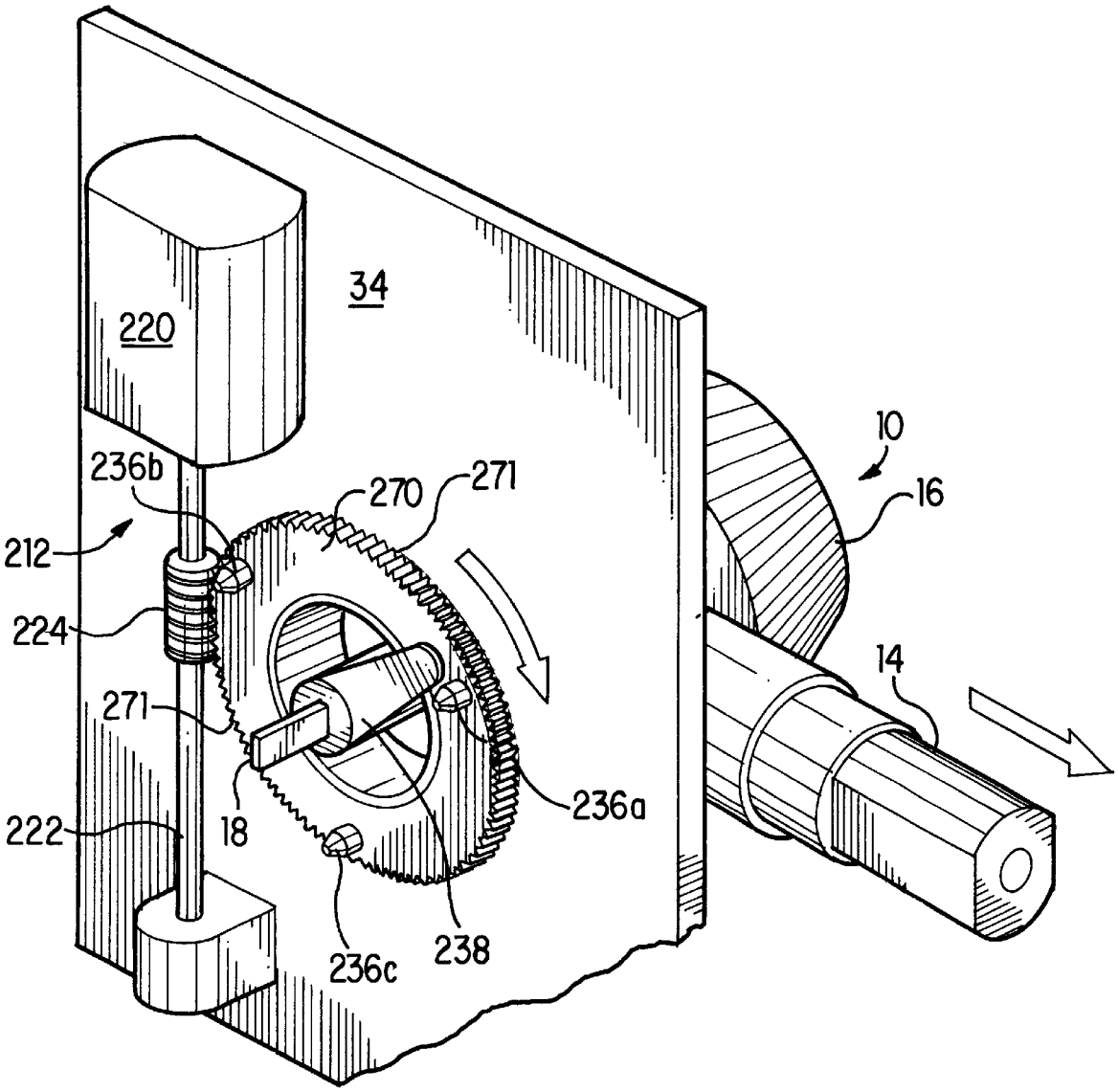
FIG. 3 is a perspective view of a dead-bolt assembly coupled with a third embodiment of an actuator in accordance with the present invention, wherein the dead-bolt assembly is in the locked position.

FIG. 3 shows another embodiment of an electrically operated actuator assembly 212 coupled to dead-bolt assembly 10. Electrically operated actuator assembly 212 has a motor 220 that rotates a rod 222. Attached to rod 222 is a first threaded gear 224. A lever 238 is attached to drive bar 18 such that rotation of lever 238 causes rotation of drive bar 18. Between lever 238 and plate 34 is a circular gear 270 having teeth 271 along its perimeter. Gear 270 is mounted in a known manner for rotation about an axis coaxial to drive bar 18. Circular gear 270 has three protrusions 236*a–c* which are spaced an equal distance apart from each other near the perimeter of circular gear 270. Protrusions 236*a–c* are sized to contact lever 238 for rotating lever 238. Circular gear 270 and threaded gear 224 are positioned in cooperation such that rotation of threaded gear 224 causes corresponding rotation in circular gear 270. Lever 238 is resilient in a direction parallel to the axis of rotation of drive bar 18.

To effect a locking or unlocking operation with electrically operated actuator assembly 212, motor 220 drives threaded gear 224, which in turn rotates circular gear 270. Rotation of circular gear 270 causes one of protrusions

236*a–c* to frictionally engage lever 238 and rotate lever 238. Rotation of lever 238 rotates drive bar 18 causing bolt 14 to extend or retract, depending upon the direction of rotation.

Figure 3A:
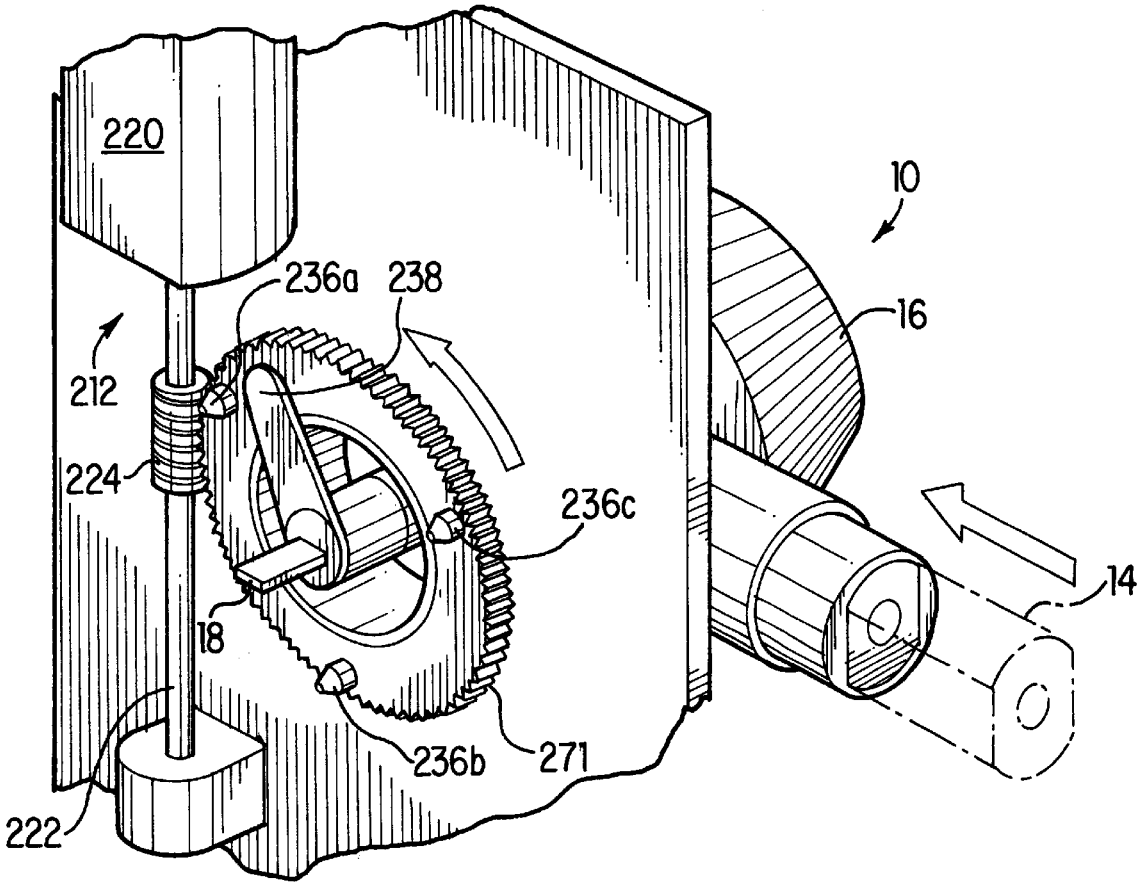
FIG. 3A is a perspective view of the dead-bolt assembly and actuator shown in FIG. 3, wherein the dead-bolt assembly is in the unlocked position.

For example, dead-bolt assembly 10 is shown in a locked position in FIG. 3. If an unlocking operation is desired using the electrically operated actuator assembly 212, motor 220 is driven such that circular gear 270 rotates in a counter-clockwise direction. Protrusion 236*a* contacts lever 238, forcing lever 238 to rotate drive bar 18 until bolt 14 retracts. After bolt 14 retracts, rotation of lever 238 is prevented by drive bar 18, which has fully rotated to its unlocked position. However, motor 220 continues to drive circular gear 270 such that protrusion 236*a* causes lever 238 to bend outwardly, allowing protrusion 236*a* to be rotated beyond lever 238, as shown in FIG. 3A. Once protrusion 236*a* has extended just beyond lever 238, motor 220 is halted. As shown in FIG. 3A, the dead-bolt assembly is then in position to be manually operated or to be electrically operated by actuator 212.

In embodiments of the invention shown in FIGS. 1–3, the levers, 28, 128 and 238 are required to be resilient to allow the electrically operated actuator assembly 212 to achieve a position whereby the actuator does not interfere with manual operation and such that the actuator is in position for the reciprocating operation. An alternative preferred embodiment is shown in FIG. 4, whereby no resilient member is required, thereby simplifying the design.

Figure 4:
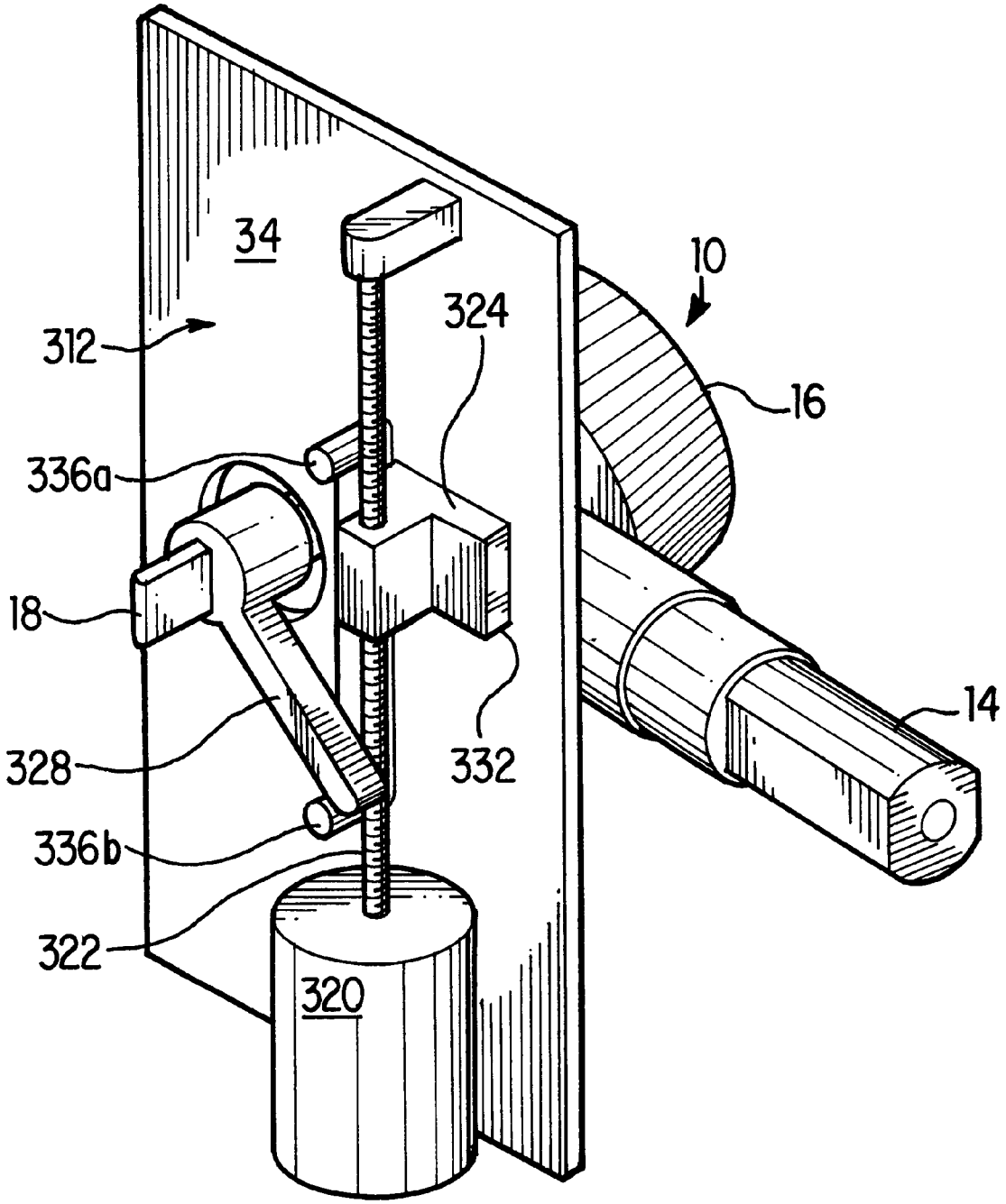
FIG. 4 is a perspective view of a dead-bolt assembly coupled with a fourth embodiment of an actuator in accordance with the present invention wherein the dead-bolt assembly is in the locked position.

FIG. 4 shows dead-bolt assembly 10 with an electrically operated actuator assembly 312 in accordance with the present invention. Actuator assembly 312 is mounted to plate 34 and includes motor 320, threaded rod 322 and a threaded actuating arm 324. Actuating arm 324 has a guide portion 332 that abuts against plate 34 preventing rotation of actuating arm 324. Actuating arm 324 has a first end portion 336*a* and a second end portion 336*b*. A lever 328 is secured to drive bar 18 to rotate drive bar 18 and extend or retract bolt 14, depending upon the direction of rotation. End portions 336*a–b* of actuating arm 324 are sized and positioned to define the ends of the range of rotation of lever 328.

Figure 4A:
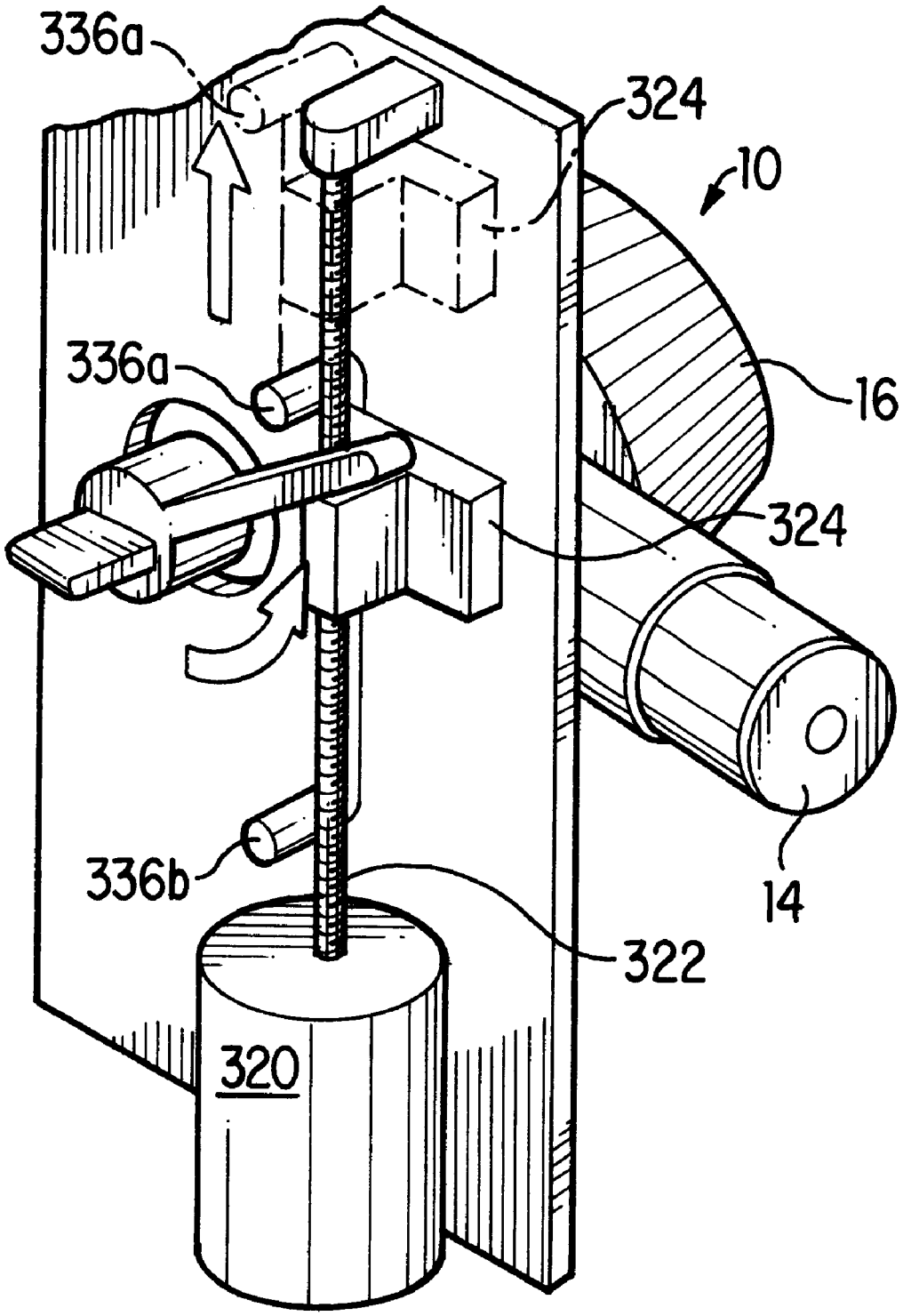
FIG. 4A is a perspective view of the dead-bolt assembly and actuator shown in FIG. 4, wherein the dead-bolt assembly is in the unlocked position.
Figure 4B:
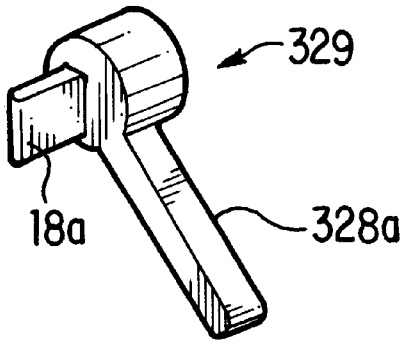
FIG. 4B is a front perspective view of a one-piece adaptor including a lever and extended drive bar for use with the embodiment shown in FIG. 4.

A preferred alternative to having a separate lever 328 that is secured onto the existing drive bar 18 is to provide a drive bar adaptor 329, as shown in FIG. 4B, which includes lever portion 328*a* and extended drive bar 18*a*. Extended drive bar 18*a* provides a physical extension of drive bar 18, making adaptor 329 particularly useful for retrofitting the actuator assembly 312 to an existing lock, which may have a relatively short drive bar. Similar drive bar adapters may be substituted for adaptor 26 and lever 28, lever 128 and lever 238.

Figure 4C:
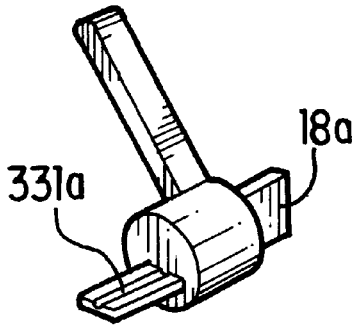
FIG. 4C is a back perspective view of an arrangement for the one-piece adaptor shown in FIG. 4B.
Figure 4D:
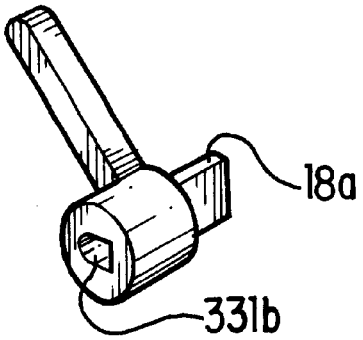
FIG. 4D is a back perspective view of an alternate arrangement for the one-piece adaptor shown in FIG. 4B.
Figure 4E:
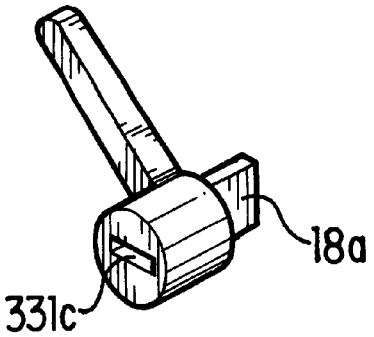
FIG. 4E is a back perspective view of another arrangement for the one-piece adaptor shown in FIG. 4B.

FIGS. 4C–4E shows alternate arrangements for the back portion of drive bar adaptor 329. The alternate arrangements are sized and configured to account for variations in drive bar arrangements from different lock manufacturers. An extended interior drive bar 331*a* is shown in FIG. 4C; a D-shaped hole 331*b* for receiving a D-shaped drive bar is shown in FIG. 4D; and a rectangular hole 331*c* for receiving a drive bar complimentary in shape is shown in FIG. 4E.

To effect a locking or unlocking operation, motor 320 is activated to rotate threaded rod 322, causing actuating arm 324 to move upward along and parallel to threaded rod 322. Movement of actuating arm 324 causes end portions 336*a* or 336*b* to frictionally engage and rotate lever 328 causing rotation of drive bar 18 and the extension or retraction of bolt 14.

In FIG. 4, dead-bolt assembly 10 is shown in a locked position. To effect an unlocking operation, motor 320 is activated to drive actuating arm 324 in an upward direction. This causes end portion 336*b* to contact and rotate lever 328. Continued movement of actuating arm 324 rotates lever 328 until bolt 14 is completely retracted. Once the bolt 14 is fully retracted (see actuator arm in phantom in FIG. 4A), motor 320 automatically reverses its direction causing actuating arm 324 to move downward until it reaches the position shown in FIG. 4A. As readily seen in FIG. 4A, dead-bolt assembly 10 is in position to be manually operated or for a subsequent operation by electrically operated actuator assembly 312.

Figure 5:
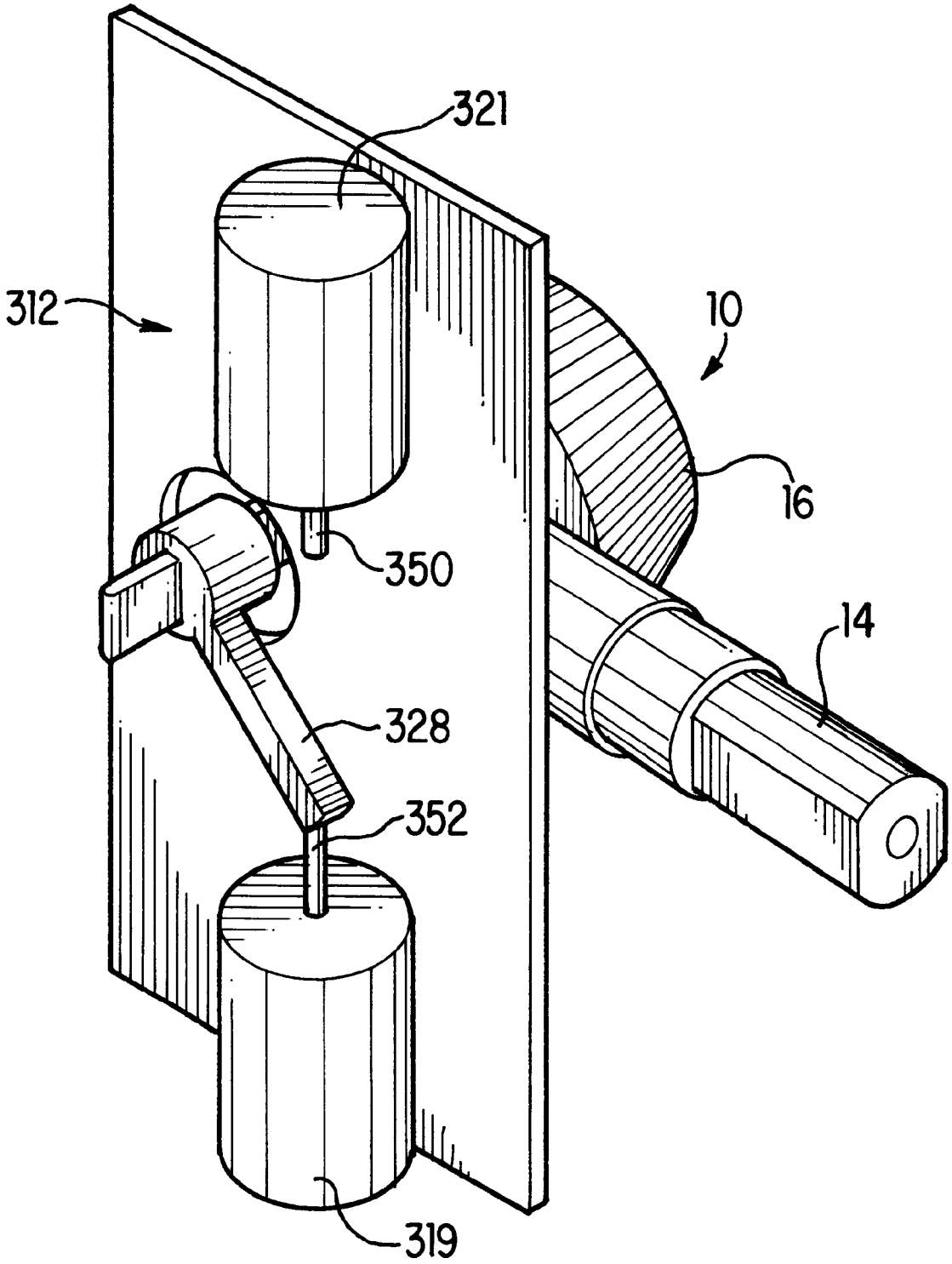
FIG. 5 is a perspective view of an alternative arrangement of the actuator embodiment shown in FIG. 4, wherein the alternative arrangement includes solenoids.

It will be appreciated by those skilled in the art that changes and modifications may be made to the embodiments described above without departing from the invention in its broader aspects. One such modification of the invention is shown in FIG. 5, wherein actuator assembly 312 shown in FIG. 4 is modified replacing motor 320 with two (2) solenoids 321, 319. Solenoid 319 has a core 352 that may be extended or retracted. Solenoid 319 is mounted such that core 352 may contact lever 328 and force it from the locked to the unlocked position. Solenoid 321 has a core 350 that is positioned such that it may contact lever 328 and force it from the locked to the unlocked position. FIG. 5 shows dead-bolt assembly 10 in the locked position. The dead-bolt assembly 10 is unlocked by actuating solenoid 319 such that core 352 pushes lever 328 such that drive bar 18 is rotated and bolt 14 is retracted. Then solenoid 319 is actuated such that core 352 is retracted. This places the assembly in position to be manually operated or electrically actuated. Similarly, a locking operation is affected by solenoid 321 being actuated to extend core 350 such that it rotates lever 328 causing the extension of bolt 14. Solenoid 321 is then actuated to retract core 350, placing the assembly in position for manual or subsequent automatic operation.

Figure 6:
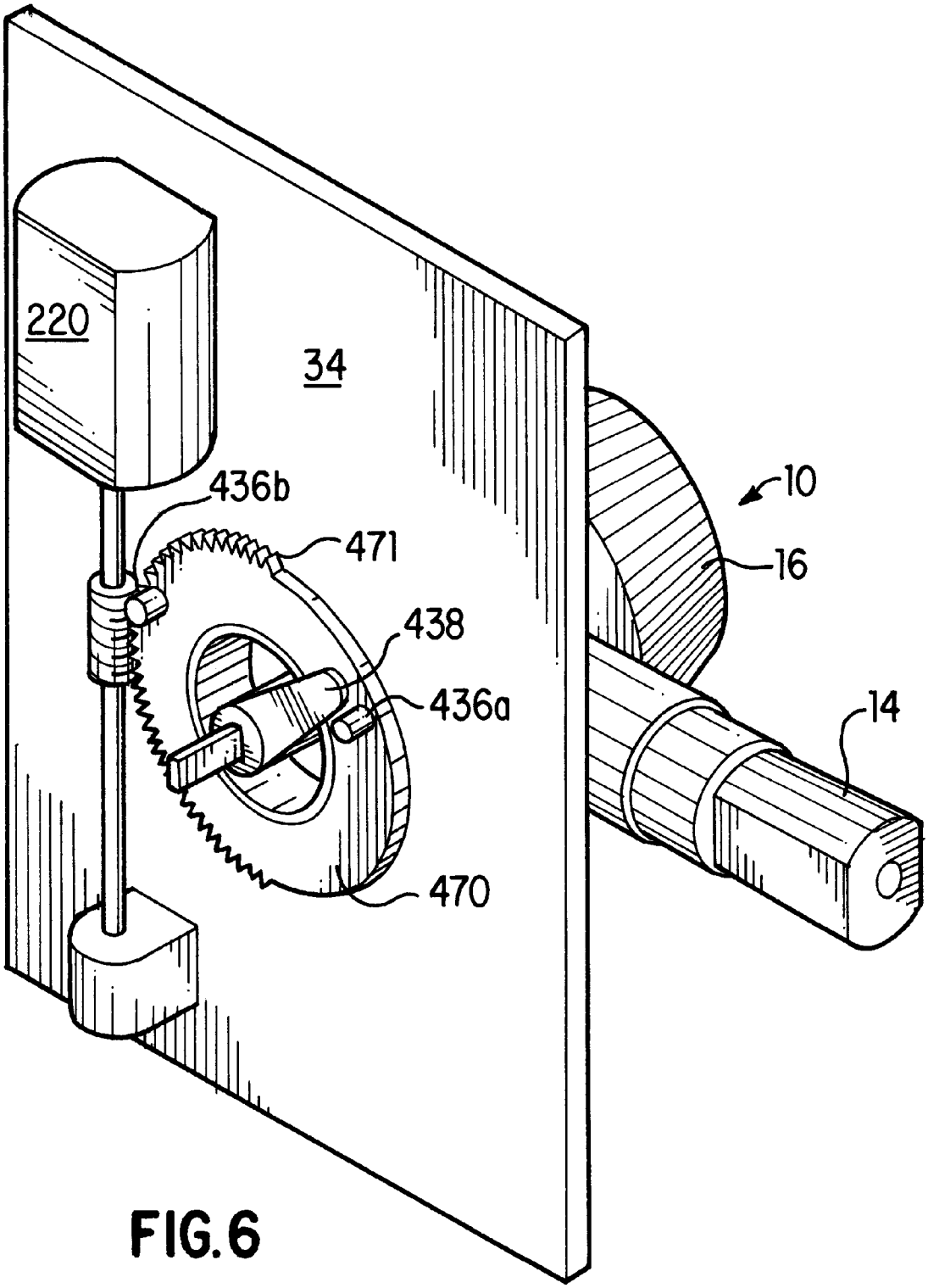
FIG. 6 is a perspective view of an alternative arrangement of the actuator embodiment shown in FIG. 3.

FIG. 6 shows a modification to the actuator embodiment shown in FIG. 3. Protrusions 236*a* and 236*b* are replaced with protrusions 436*a* and 436*b*, which are sized to extend beyond lever 438. A protrusion corresponding to 236*c* is not required. Additionally, gear 470 only needs approximately half as many teeth 471 as gear 270. Rigid lever 438 replaces lever 238 in this modification and need not be resilient. FIG. 6 shows dead-bolt assembly 10 in the locked position. Assembly 10 is unlocked by activating motor 220 to rotate circular gear 470 counterclockwise, thereby rotating lever 438 causing drive bar 18 to retract bolt 14. Once bolt 14 has reached the completely retracted position, motor 220 automatically reverses turning circular gear 470 clockwise until gear 470 returns to its position shown in FIG. 6. Similarly, assembly 10 is locked by rotating circular gear 470 clockwise until bolt 14 completely extends, and then rotating circular gear 470 counterclockwise until gear 470 returns to its position shown in FIG. 6.

Figure 7:
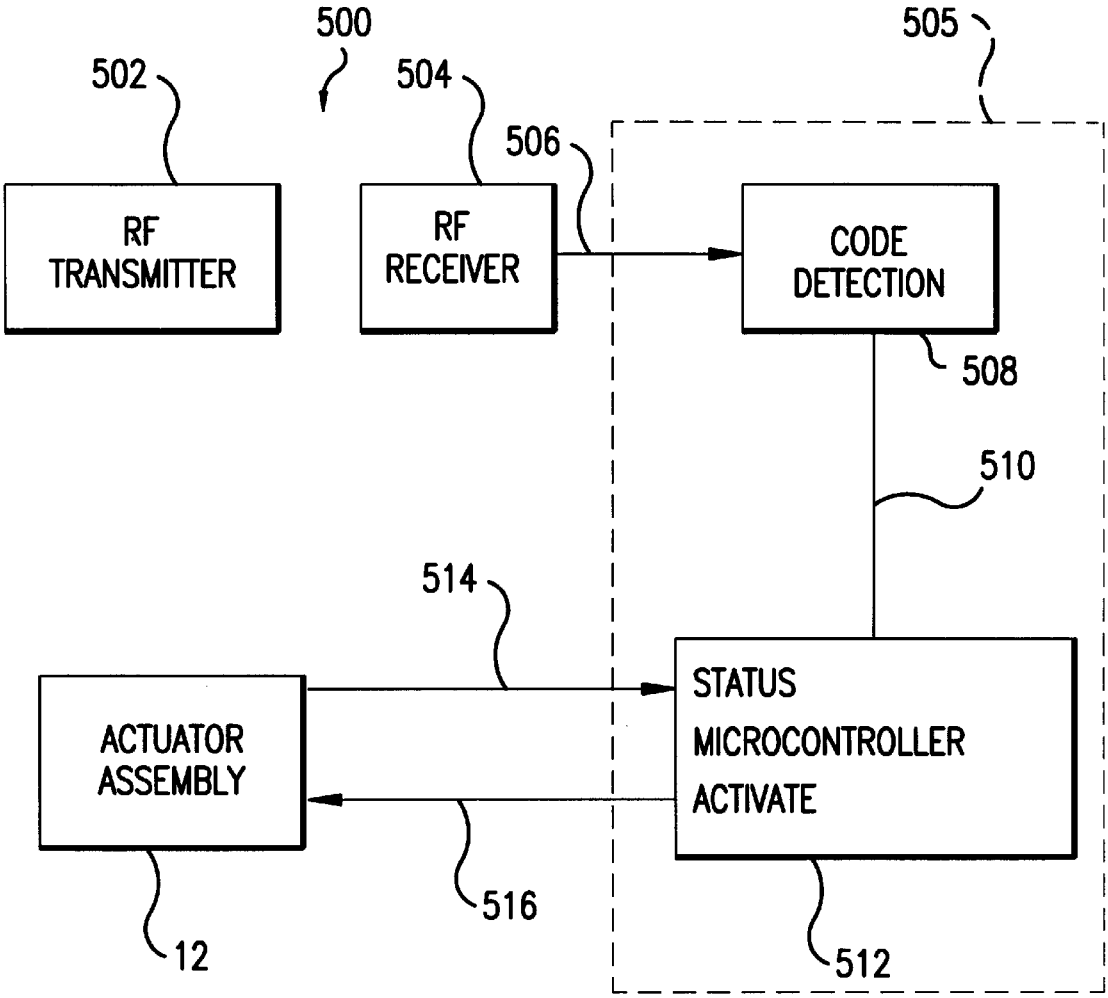
FIG. 7 is a block diagram of a remote control system that controls an actuator in accordance with the present invention.

The electronic controls for activating and deactivating the actuator assembly in accordance with the present invention may be accomplished in any known manner. Preferably, the actuator is controlled by a remote control transmitter and receiver which, for example, may operate using radio frequency (RF). FIG. 7 is a block diagram illustrating an embodiment for controlling actuator assembly 12. A circuit 500 is composed of an RF transmitter 502, RF receiver 504, and a control circuit 505, including a code detection circuit 508 and microcontroller 512. RF transmitter 502 transmits, via radio frequency, preferably encrypted codes to lock and unlock the actuator assembly. Preferably, RF transmitter 502 is of the type commonly used with automobile locks. RF receiver 504 receives radio frequency signals transmitted by transmitter 502 and creates a demodulated signal 506 that is transmitted to code detection circuit 508. Code detection circuit 508 determines whether a valid signal was received from the transmitter 502. A valid/nonvalid indication 510 is transmitted by code detection circuit 508 to microcontroller 512. If a valid signal was received, microcontroller 512 deciphers the command requested. Microcontroller 512 then sends the appropriate activation signals 516 to the actuator assembly to lock or unlock the actuator assembly. Microcontroller 512 also monitors the status of the actuator assembly via status signals 514.

Figure 8:
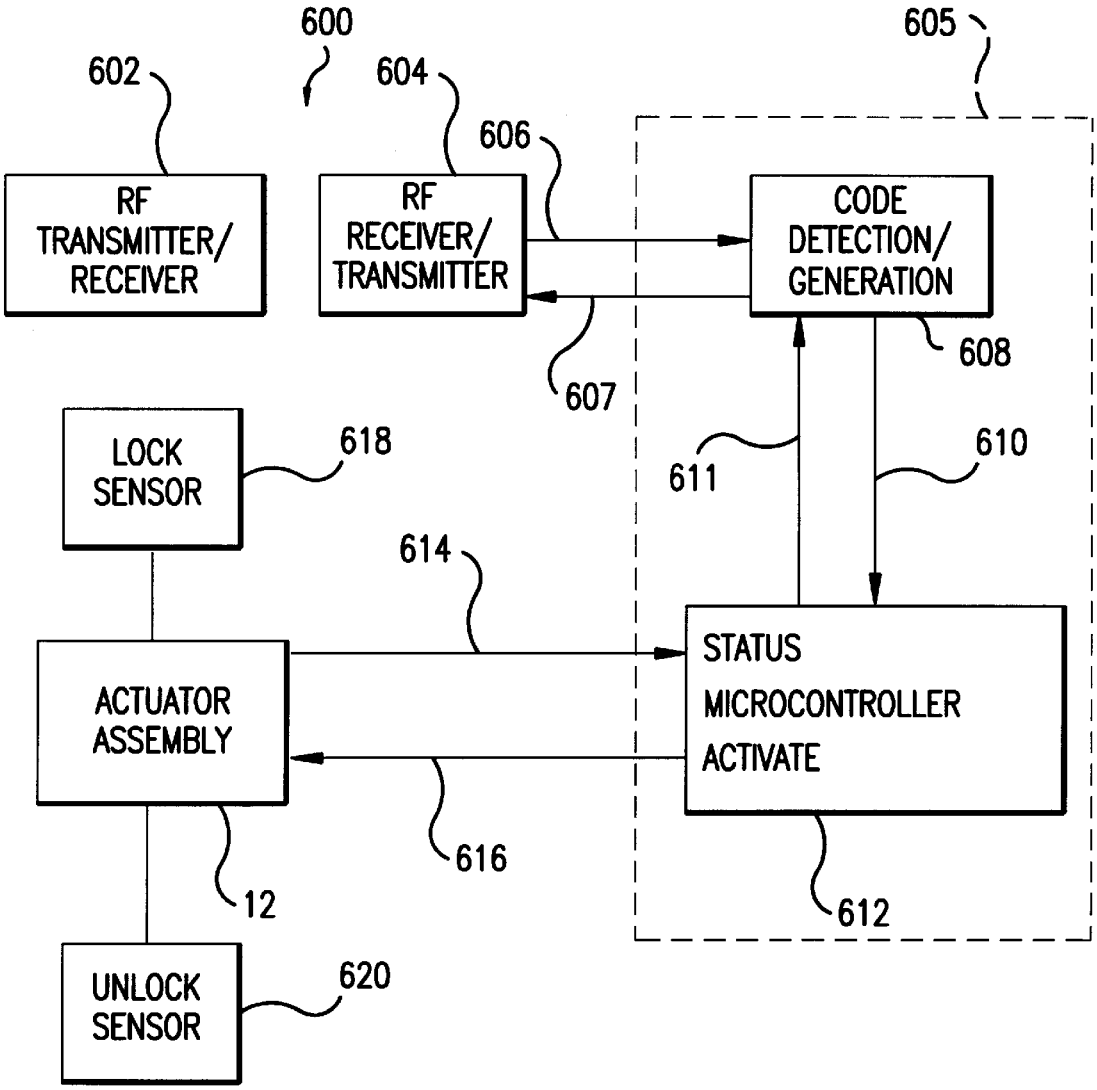
FIG. 8 is a block diagram of a remote control system that controls and reports status of an actuator in accordance with the present invention.

FIG. 8 is a block diagram illustrating a preferred embodiment for controlling actuator assembly 12 and receiving status information from actuator assembly 12. A circuit 600 is composed of two transceivers, an RF transmitter/receiver 602 and RF receiver/transmitter 604, and a control circuit 605, including a code detection/generation circuit 608 and microcontroller 612. Additionally, for sensing the status of the actuator assembly, lock sensor 618 and unlocked sensor 620 are provided.

For controlling actuator assembly 12, circuit 600 operates in a manner similar to circuit 500. RF transmitter/receiver 602 transmits, via radio frequency, preferably encrypted codes to lock and unlock the actuator assembly. RF receiver/transmitter 604 receives radio frequency signals transmitted by transmitter/receiver 602 and creates a demodulated signal 606 that is transmitted to code detection/generation circuit 608. Code detection/generation circuit 608 determines whether a valid signal was received from transmitter/receiver 602. A valid/nonvalid indication 610 is transmitted by code detection/generation circuit 608 to microcontroller 612. If a valid signal was received, microcontroller 612 deciphers the command requested. Microcontroller 612 then sends the appropriate activation signals 616 to the actuator assembly to lock or unlock the actuator assembly.

Lock sensor 618 and unlock sensor 620 are provided to detect the status of the dead-bolt assembly and the actuator assembly. Lock sensor 618 provides an indication that the dead-bolt assembly has been successfully locked. Unlock sensor 620 provides an indication that the dead-bolt assembly has been successfully unlocked. The sensors may be reed switches with a magnet, Hall effect switches with a magnet, optical sensors or metal electrical contacts. Additional sensors may be used to sense additional positions of the actuator assembly or lock.

The status of the actuator assembly and the lock as determined from any sensors, such as lock sensor 618 and unlock sensor 620, may be transmitted to the microcontroller via status signals 614. Microcontroller 612 may alert code detection/generation circuit 608 to generate an appropriate status signal via status line 611. Code detection/generation circuit 608 may then create a modulated signal 607 which is transmitted via RF receiver/transmitter 604 to RF transmitter/receiver 602. The status received by RF transmitter/receiver 602 may be used to generate a visual or audible indication of status to the user.

The electronics for controlling the actuator assembly in accordance with the present invention are preferably battery powered and most preferably, include a visual and/or audible indication of a low battery condition.

Figure 10:
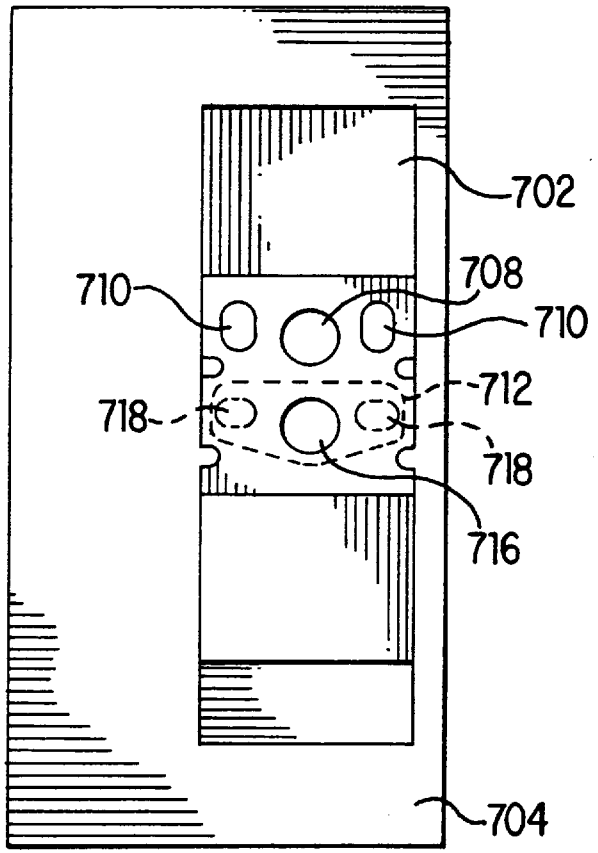
FIG. 10 a front plan view of the plate of FIG. 9 with the mounting portion in a second position.
Figure 9:
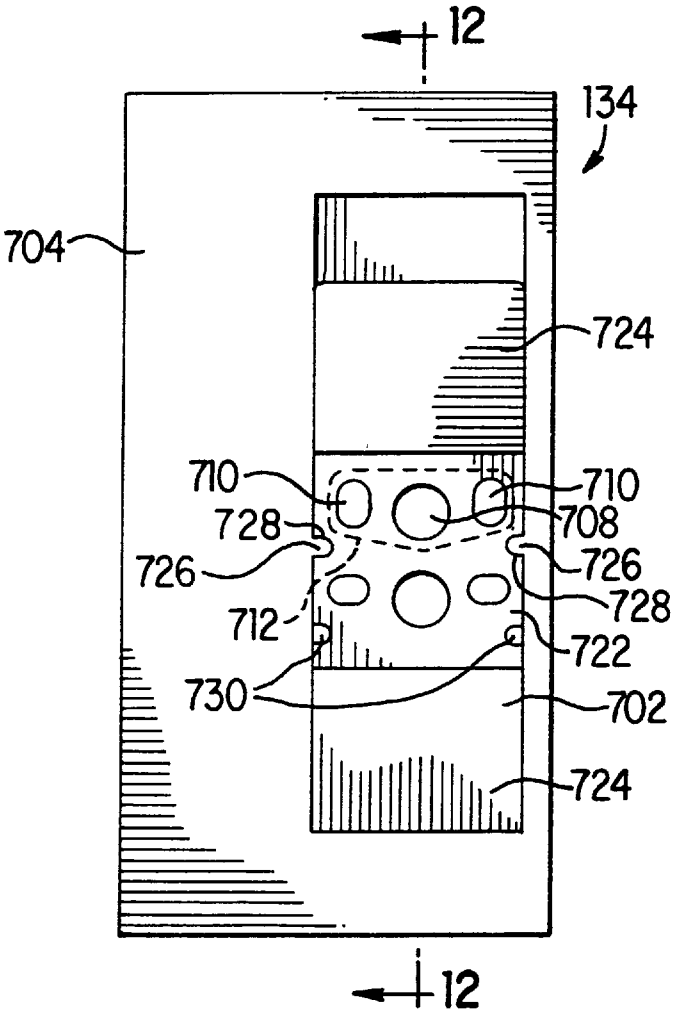
FIG. 9 is a front plan view of a plate having a mounting portion in a first position for retrofitting an existing dead-bolt assembly with an actuator in accordance with the present invention.

The actuator assemblies described above and shown in FIGS. 1–6 may be readily retrofit on an existing lock or dead-bolt assembly. To facilitate retrofitting an existing lock or dead-bolt assembly, a plate 134 including a mounting portion 702 and a support portion 704 is provided as shown in FIGS. 9–12. In FIG. 9, mounting portion 702 is shown in a first position wherein a first set of holes, including center hole 708 and perimeter holes 710 are aligned with an opening 712 in support portion 704. In FIG. 10, mounting portion 702 is shown in a second position wherein a second set of holes, including center hole 716 and perimeter holes 718 are aligned with opening 712.

Center holes 708, 716 are for receiving the drive bar and perimeter holes 710, 718 are for receiving the bolts that hold the lock to the door. In the preferred embodiment, the first and second set of holes are sized and spaced to accommodate a number of different locks from a variety of lock manufacturers. For example, mounting portion 702 shown in FIGS. 9–10 has circular center holes 710, 718 spaced 1.875 inches apart from center to center having diameters of 1.2 inches. Perimeter holes 710, 718 are generally oval in shape with holes 710 being rotated approximately ninety degrees from holes 718.

Figure 12:
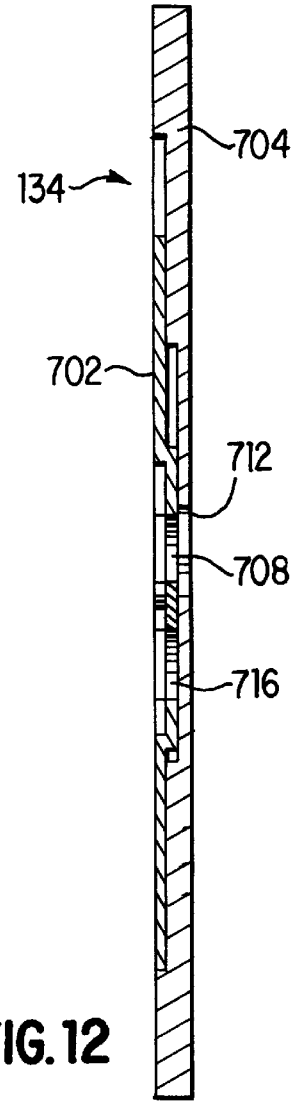
FIG. 12 is a cross-sectional view of the plate shown in FIG. 9 taken along line 12—12.
Figure 11:
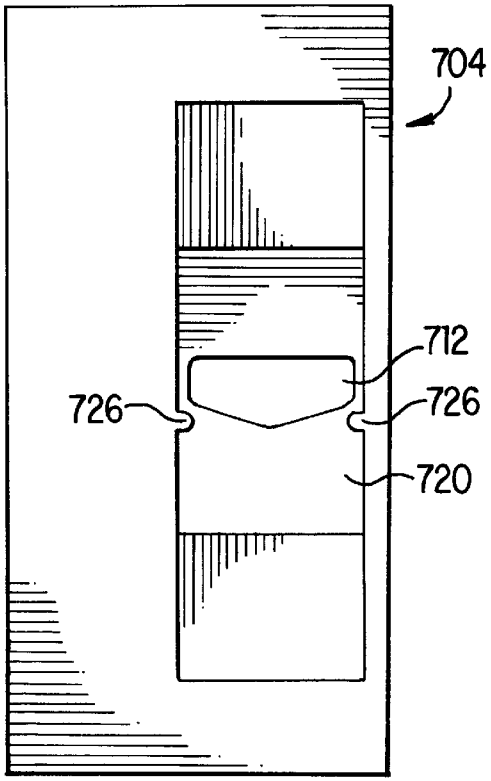
FIG. 11 is a front plan view of the plate of FIG. 9 with the mounting portion removed.

As shown in FIGS. 11 and 12, support portion 704 has a recess portion 720 for receiving mounting portion 702. Similarly, mounting portion 702 has a recessed portion 722 and flanged end portions 724. Formed within recessed portion 720 are protrusions 726. A first pair of notches 728 and a second pair of notches 730 are provided in mounting portion 702 for alternatively mating with protrusions 726 to align mounting portion 702 in the first and second positions shown in FIGS. 9 and 10, respectively.

To retrofit an existing lock using plate 134, first, the interior cylinder or knob is removed. Then, support portion 704, preferably including a preassembled actuator assembly, such as assembly 12, assembly 112, assembly 212 or assembly 312 is positioned over the exterior cylinder and existing mounting hardware. For example, for assembly 312 shown in FIGS. 4, 4A and 4B, the preassembled actuator assembly may include motor 320, threaded rod 22, actuating arm 324 and any appropriate circuitry, including any sensors desired, prearranged and assembled onto plate 134. Next mounting portion 702 is positioned over the existing mounting hardware by alignment in either the first or second position. Then, a rotating device, such as adaptor 26 and lever 28, lever 128, lever 238, lever 328 or adaptor 329, is secured onto the drive bar. Finally, a protective cover may be provided over plate 134 and the interior cylinder or knob may be retrofit onto the extended drive bar, completing the retrofit of an actuator assembly onto an existing lock or dead-bolt assembly.

Described above is an electrically operated actuator that is capable of automating locking and unlocking of door locks and dead-bolt assemblies, while preserving the conventional manual operation of such locks and assemblies. Additionally, the electrically operated actuator is readily retrofit on an existing lock or dead-bolt assembly.

While the present invention has been described with respect to certain preferred embodiments and modifications thereof, it will be appreciated by those skilled in the art that certain other modifications are possible and fall within the scope of the invention as expressed in the accompanying claims.

What is claimed is:

1. An electrically operated actuator in combination with a dead bolt assembly, the dead bolt assembly comprising a lock having a drive bar and a bolt, the bolt being operably coupled to the drive bar such that rotation of the drive bar extends and retracts the bolt linearly, the actuator comprising:

a lever that extends and retracts the bolt linearly, the lever being attached to the drive bar at one end and being unattached at another end opposite the attached one end, said lever having an axis of rotation that is coaxial with an axis of rotation of the drive bar, said lever being pivotal from a first position wherein the bolt is retracted to a second position wherein the bolt is extended;

a motor capable of rotating a threaded rod attached thereto in a clockwise and counterclockwise direction, said motor being responsive to an electrical signal;

an actuating arm screwed onto said threaded rod having a first protrusion on one end of said arm and a second protrusion on an opposite end of said arm, said arm having means to prevent rotation of said arm about said threaded rod;

said actuating arm being positioned on said threaded rod such that said first protrusion is capable of contacting said lever at a first contact point and pivoting said lever to said first position and said second protrusion is capable of contacting said lever at a second contact point and pivoting said lever to said second position, wherein said first contact point is different from said second contact point.

2. The actuator of claim 1 wherein said electrical signal is generated by a circuit comprising:

a transmitter for transmitting a request to actuate the actuator;

a receiver for receiving the request to actuate the actuator;

a control circuit, operably connected to said receiver, that generates said electrical signal to said driving means if the request is valid.

3. The actuator of claim 2 wherein said control circuit comprises a code detection circuit for determining whether the receiver received a valid request from the transmitter and a microcontroller for deciphering the valid request from the code detection circuit and generating said electrical signal to said driving means.

4. The actuator of claim 2 further comprising a plurality of sensors positioned around the rotating means for sensing the status of the lock.

5. The actuator of claim 4 wherein said transmitter is a first transceiver and said receiver is a second transceiver and the status of the lock is transmitted to said first transceiver by said second transceiver.

6. An actuator in combination with a dead bolt assembly, the dead bolt assembly comprising a lock having a drive bar and a bolt, the bolt being operably coupled to the drive bar such that rotation of the drive bar extends and retracts the bolt linearly, the actuator comprising:

a lever attached to the drive bar at one end and being unattached at another end opposite the attached one end, said lever having an axis of rotation that is coaxial with an axis of rotation of the drive bar, said lever being pivotal from a first position wherein the bolt is retracted to a second position wherein the bolt is extended, a motor responsive to an electrical signal, said motor having a threaded rod attached thereto that is capable of rotation by the motor in a clockwise and counterclockwise direction;

an actuating arm screwed onto said threaded rod having a first protrusion on one end of said arm and a second protrusion on an opposite end of said arm, said arm having means to prevent rotation of said arm about said threaded rod;

said actuating arm being positioned on said threaded rod such that said first protrusion is capable of contacting and pivoting said lever to said first position and said second protrusion is capable of contacting and pivoting said lever to said second position.

7. The actuator of claim 6 wherein said threaded rod is oriented to be perpendicular to the bolt.

8. The actuator of claim 6 wherein said lever is integral with an extended drive bar portion.

9. The actuator of claim 6 wherein said electrical signal is generated by a circuit comprising:

a transmitter for transmitting a request to actuate the actuator;

a receiver for receiving the request to actuate the actuator;

a control circuit, operably connected to said receiver, that generates said electrical signal to said motor if the request is valid.

10. The actuator of claim 9 wherein said control circuit comprises a code detection circuit for determining whether the receiver received a valid request from the transmitter and a microcontroller for deciphering the valid request from the code detection circuit and generating said electrical signal to said motor.

11. The actuator of claim 9 further comprising a plurality of sensors positioned around the rotating means for sensing the status of the lock.

12. The actuator of claim 11 wherein said transmitter is a first transceiver and said receiver is a second transceiver and the status of the lock is transmitted to said first transceiver by said second transceiver.

* * * * *